US008821693B2

(12) United States Patent
Kim et al.

(10) Patent No.: US 8,821,693 B2
(45) Date of Patent: Sep. 2, 2014

(54) REFRACTORY OVEN DOORS AND REFRACTORY OVEN DOOR FRAMING WALLS OF A COKE OVEN BATTERY

(75) Inventors: Ronald Kim, Essen (DE); Werner Hippe, Gladbeck (DE); Ulrich Kochanski, Gummersbach (DE)

(73) Assignee: Thyssenkrupp Uhde GmbH, Dortmund (DE)

( * ) Notice: Subject to any disclaimer, the term of this patent is extended or adjusted under 35 U.S.C. 154(b) by 1066 days.

(21) Appl. No.: 12/734,903

(22) PCT Filed: Nov. 27, 2008

(86) PCT No.: PCT/EP2008/010062

§ 371 (c)(1),
(2), (4) Date: Aug. 19, 2011

(87) PCT Pub. No.: WO2009/071233

PCT Pub. Date: Jun. 11, 2009

(65) Prior Publication Data

US 2012/0103782 A1 May 3, 2012

(30) Foreign Application Priority Data

Dec. 4, 2007 (DE) ..... 10 2007 058 473

(51) Int. Cl.
*C10B 1/06* (2006.01)
*C10B 25/06* (2006.01)
*C10B 25/12* (2006.01)

(52) U.S. Cl.
CPC ..... *C10B 25/06* (2013.01); *C10B 25/12* (2013.01)
USPC ..... 201/15; 201/27; 202/222; 202/223; 202/242; 202/245; 202/248; 202/267.1; 202/270

(58) Field of Classification Search
USPC ..... 201/15, 27; 202/93, 102, 151, 263, 217, 202/222, 223, 224, 245, 242, 248, 267.1, 202/270
See application file for complete search history.

(56) References Cited

U.S. PATENT DOCUMENTS 4,287,024 A * 9/1981 Thompson ..... 202/134
4,574,035 A * 3/1986 Highley et al. ..... 202/242
(Continued)

FOREIGN PATENT DOCUMENTS

CA 1 270 460 A1 6/1990
DE 29 45 107 A1 5/1981
(Continued)

*Primary Examiner* — Nina Bhat
(74) *Attorney, Agent, or Firm* — Marshall & Melhorn, LLC

(57) ABSTRACT

A heat-resistant door device for closing a horizontal coke oven chamber is made of a refractory material, using a material containing silica or a material containing silica and aluminum oxides, in particular. The material has a low temperature expansion coefficient and it is thermally well insulating so that the door is not deformed and/or distorted during the coal carbonization process. The door device is built of a coke oven wall mainly located above the door and embracing the door as well as of a mobile door located underneath. Thereby less cold ambient air enters into the coke oven chamber and radiation losses are minimized. The door may be comprised of an ellipsoidal bulge by which the coke can be better pushed into the coking chamber. The oven wall embracing the oven door can also be made of a refractory material containing silica or of a material containing silica and aluminum oxides.

22 Claims, 4 Drawing Sheets

(56) References Cited

U.S. PATENT DOCUMENTS

| | | | | |
|---|---|---|---|---|
| 4,741,808 | A * | 5/1988 | Holz et al. | 202/248 |
| 5,114,542 | A * | 5/1992 | Childress et al. | 201/15 |
| 5,447,606 | A | 9/1995 | Pruitt | |
| 5,658,434 | A | 8/1997 | Schlosser | |
| 5,928,476 | A * | 7/1999 | Daniels | 201/27 |
| 7,077,934 | B2 | 7/2006 | Kolassa et al. | |
| 8,465,626 | B2 * | 6/2013 | Schuecker et al. | 201/1 |
| 2011/0023860 | A1 * | 2/2011 | Schuecker et al. | 126/197 |

FOREIGN PATENT DOCUMENTS

| | | | |
|---|---|---|---|
| DE | 102 01 985 | A1 | 7/2003 |
| DE | 10 2005 015 301 | A1 | 10/2006 |
| EP | 0 186 774 | B1 | 10/1988 |
| EP | 0 742 276 | A1 | 11/1996 |
| EP | 0 724 007 | B1 | 1/1999 |
| EP | 1 293 552 | B1 | 8/2005 |
| GB | 1 555 400 | * | 11/1979 |
| WO | WO 2004/007640 | A1 | 1/2004 |

* cited by examiner

REFRACTORY OVEN DOORS AND REFRACTORY OVEN DOOR FRAMING WALLS OF A COKE OVEN BATTERY

BACKGROUND OF THE INVENTION

The present invention relates to a closing device for a coke oven typically encountered in so-called "Non-recovery" or "Heat-recovery" coke oven batteries. The present invention also relates to a method for operating such coke ovens with the inventive closing device. The closing device closes horizontally directed openings of coke oven batteries in a manner that is as impermeable to air as possible. These openings situated at the front and rear side oven walls serve for charging horizontal coke oven chambers which are cyclically operated and which are pushed and charged, respectively, upon completion of a coal carbonization cycle.

Some types of coke ovens are also charged through openings located in the oven top area. The openings positioned at the lateral oven walls then serve to level-off the coke cake with levelling devices, e.g. leveller bars. Thereby, charging cones frequently occurring on charging and adversely affecting the coal carbonization process can be leveled off and the bulk density of the coke cake can be optimally adjusted for the coal carbonization process by leveling facilities.

Frequently the oven doors are integrated into oven walls and embraced by them. Depending on the size of openings or doors, they can seal-off the entire lower area of an oven or cover only parts in order to achieve an optimal charging and homogenization of the coke cake. The coal carbonization process takes 16 to 192 hrs for one coking cycle, depending on the implemented plant design, and it is carried out at temperatures ranging from 800 to 1500° C. At the corners of a coke oven, the temperature is a little lower than in the center.

Owing to the cornered shape of a coke oven, it has recesses and inaccessible spots which adversely affect the coal carbonization process because due to thermal conduction towards the outside, coke, and especially coke in the corners, is noticeably cooler than the main coke cake in the interior. Owing to their design and construction with joints and gaps in the brickwork, the corners and edges of a coke oven, in particular, have an increased thermal conductivity towards the exterior. Moreover, there are load-bearing devices installed in the area near the door which do not contribute to heating-up. Secondary air soles frequently do not reach to the door underside so that this area is noticeably cooler.

Walls of coke ovens are frequently made of refractory bricks. Typical materials for the design and construction of walls are masonry bricks or other suitable refractory construction materials. These substances have a high resistance to heat from the coal carbonization process and dissipate only a small part of the heat occurring on coal carbonization to the exterior so that heating from foreign sources is usually not necessary. The heating of coke ovens is realized by supplying air into the oven chamber with a partial combustion of the coal charged. For this purpose, a precisely dosed quantity of air is supplied. On charging a coke oven, coal is usually not filled up to the oven top but only up to part of the height of the entire oven.

The oven free space located there above is utilized for capturing gases which evolve during a coal carbonization process. A partial combustion of substances dissipated by coal takes place in the oven free space when heated-up. To this effect, a sub-stoichiometrical quantity of air required for combustion, the so-called primary air, is fed in. The openings for primary air feeding are so laid that air streams into the oven free space above the coke cake. This is realized through openings in the area of the oven wall above the oven door or through openings in the oven top area.

Partially burnt gases evolving during the combustion process are collected and passed through channels within the coke cake, wall or doors into the area under the oven floor. These channels are also called "downcomer" channels. So-called secondary air soles formed by channels extending under the oven floor and in which gases from coal carbonization are burnt with additionally supplied air, the so-called secondary air, are located in the area under the oven floor. Since the floor of a coke oven usually has high thermal conductivity, the coal carbonization process is also heated from below by this secondary combustion.

"Downcomer" channels may rest in form of metal tubes in the coke cake, but they can also be accommodated in walls located away from the doors. Thereby, the oven free space is relieved from the pressure building-up during the coal carbonization process. Finally, coking gases can also be discharged trough intermediate spaces in the doors. Thereby, coke oven doors are relieved from the pressure building-up there.

Doors in the coke oven chamber wall on the front side of a coke oven are frequently designed and built as door frames with a base plate. So-called plugs comprised of a material highly resistant to heat and sealing the coke cake on coal carbonization beyond the wall thickness versus the environment are mounted on them. During a coal carbonization process, such doors can keep heat losses towards the exterior at a relatively low level, if the door plug tightly seals the space between coke oven chamber and coke oven door. A heat loss during pushing of a coke oven chamber only occurs if cold air reaches into the interior of a coke oven chamber and if a heat loss can be realized by radiation.

Doors of coke ovens can be fabricated both from metals and refractory oven construction materials. Frequently oven doors are made of a ceramic material, because doors made of metal have some drawbacks. A major problem of metallic protection shields is thermal expansion. A consequence of thermal expansion versus the ceramic material of the embracing wall is that the door may deform during the coal carbonization process and fails to fit exactly on the opening, whereby false air can be aspirated.

Another problem of metallic doors is permanent deformation. Depending on the steel used, a severe inward or outward bulging will occur. If exposed to extreme thermal loads, all steel grades evidence permanent deformation. Moreover, the production of steel highly resistant to heat is expensive and its processing is difficult. Another problem is posed by the high level of surface radiation of metallic oven doors which results from the high thermal conductivity of this material.

Doors which are exclusively built-up of refractory construction materials, in turn, have a disadvantage in that they are heavy in weight and require stable door bodies as well as actuating devices. Refractory bodies are frequently implemented in form of so-called plugs into a door body frame. These refractory door plugs often fail to provide sufficient tightness, thus allowing coking gases to escape to the exterior and carbon to penetrate into the connecting elements between door and ceramic body. As a result, the door may suffer from damage which frequently entails extensive repairs and premature replacement of doors. Frequently located between door frames and plugs are gas collecting spaces which are mixed with fine dusts and carbon due to leakages in ceramic bodies. Moreover, this ceramic structure of material often leads to fractures in the plug, necessitating costly door repairs.

DE 2945017 A1 describes a coke oven door made of a metallic material. The metallic material is framed in form of a plug in a door moving device. The plug is so constructed that it forms a vertical gas collecting space in its interior extending in longitudinal direction and being accessible to gaseous coking products. On the side facing the oven chamber, the plug is comprised of openings through which gases can be passed into the collecting space and to combustion or further processing. To achieve better thermal insulation, an insulating device comprised of a thermally insulating material can be mounted between door and plug. The plugs can be comprised of multiple parts or be provided with expansion joints to compensate for thermal expansion. The actual door plug can be connected by bolting devices to the door body. The coke oven door covers the entire coke oven chamber wall on the front side of an oven. Through special openings, a connection is established between the door-side vertical and chamber-side horizontal gas collecting spaces.

EP 186774 B1 describes a door plug made of a ceramic material. The door plug is bolted or wedged with a metal carrier frame. In outward direction from the door plug, there is an insulating layer which together with the door plug forms a gas collecting space. Thereby, the door seals are relieved as gas is discharged to the gas collecting space and ultimately into the secondary air sole. In operating status, the plugs protrude into the oven chamber and keep the oven charge at a certain distance away from the door body, with the door body being pressed by a latching device against the door frame of the oven during the carbonization process. In particular, a hydraulically bonding refractory concrete is provided for as ceramic material. Essential constituents of refractory concrete are aluminum oxide, silicon oxide and iron oxide. The ceramic plate can also be comprised of exchangeable elements. This allows for easier exchange in case of damage. Except for some small recesses, the coke oven door covers the entire coke oven chamber wall on the front side of the oven.

All door designs and structures available have a disadvantage in that they can be easily damaged because they are exposed to high mechanical forces during opening and closing. Doors made of a ceramic material can be easily damaged and on the whole they have a shorter service life. Conversely, door plugs made of a metallic material are exposed to loads due to thermal expansion whereby they may be deformed and consequently they cannot seal the oven door tightly after a short time. Moreover, owing to thermal expansion, the doors may get stuck in closed position which implies a safety risk for a coke oven with a high heat throughput.

Doors of coke oven chambers must tightly close the coke oven chamber above all during the coal carbonization process. By-products that may escape from a coke oven chamber through leaky coke oven doors are produced during coal carbonization. In particular, these are coking gases and tarry condensates. They pose some risk and hazard to environment and operating staff. Moreover, on coke pushing, cold air penetrates trough a door opening into a coke oven and causes a coke oven chamber to cool-off. This is disadvantageous because combustion of coke oven gas frequently just is sufficient to generate the coking energy. Consequently, a cooling-off of coke oven chamber walls entails increased coal consumption and deterioration in coke quality.

Now, therefore, it is the object of the present invention to provide a door design and structure for a coke oven battery or for an oven bank that evidences no problems with high temperature differences on pushing of coke oven chambers. It should be designed to tightly seal the oven interior, thus preventing any fine constituents from escaping from the oven chamber to the exterior which might pose difficulties to operating the coke oven chamber and which represent a hazard to environment and a problem to coke oven operation. While pushing the contents out from a coke oven chamber, as little cold air as possible should enter into the interior of a coke oven chamber, keeping the heat loss due to radiation to the exterior as low as possible.

The material of the door structure should be stable to temperature impacts and be fracture-proof, thus affording high service life and involving low cost of operation. Finally, the material should be cheap in production. Another object of the present invention is eliminating irregularities in temperature distribution of the coke cake resulting from the cornered shape of the coke oven chamber. A deteriorated coal carbonization in the cooler corners of the coke oven battery should be prevented, if possible.

BRIEF SUMMARY OF THE INVENTION

The present invention solves this task by providing a mono-part or multiple-part oven door structure made of a heat-resistant material which exactly fits into the coke oven opening without any gaps, with the bottom part being designed and constructed as a mobile coke oven chamber door and the top part being designed and constructed as a firmly seated coke oven wall made of said material. The material shall be properly composed to keep temperature expansion low and fracture strength high. The upper part of the coke oven chamber opening is sealed-off by the coke oven chamber wall. The major part of the door-embracing coke oven chamber wall is located above the coke oven chamber door. During opening, the coke oven chamber wall remains as an outer wall of the coke oven chamber wall in the coke oven opening.

The lower part is designed and constructed as a mobile door which depending on the type of the door device can be moved from the coke oven chamber opening in swiveling motion or in a vertically upward motion or in its entirety. A minor part of the coke oven chamber wall can laterally embrace the doors. As a result of the exactly fitting framing of the coke oven door, there will be no leakages between the coke oven door and coke oven wall.

The upper edge of the coke cake advantageously terminates shortly under the lower edge of the coke oven chamber wall part located above the door. The distance between the lower edge of the upper coke oven chamber wall and the upper edge of the coke cake advantageously ranges between 50 and 500 mm. But preferably it should range between 100 and 200 mm. Thereby, the coke cake can be pushed out, without this entailing penetration of cold air pressed into the coke oven chamber because this is prevented by the upper part of the coke oven chamber wall. Heat radiation is also minimized in this way.

The wall embracing the oven door is preferably made of a refractory material or of the same material as the oven doors. Thereby, the door structure will not become distorted or get stuck because the temperature expansion coefficients of the coke oven chamber door and the door-embracing wall are nearly the same. It is possible to execute the inventive door as a plug, if required by design and construction. However, it is preferably inserted directly into the opening destined for this purpose. The pushing device preferably has the same cross-section as the door opening and the door of the coke oven chamber. Thereby, the coke cake can be pushed-out without this causing coke to slide behind the pushing device. A heat loss and penetration of cold air from the environment is thus minimized, too.

The inventive door structures do not contain any gas collecting spaces in order to thus degrade the pressure build-up during a coal carbonization process. Instead, this is taken charge of by so-called "downcomer" channels which are accommodated in lateral walls having no doors. These "downcomer" tubes serve for discharging the evolving coking gases into the secondary air sole. On operation of the inventive device, one can also dispense with a plug so that a non-filled space is created between door and coke cake. It can lead-off the pressure building-up there.

Claimed in particular is a device for closing a coke oven which is charged or prepared for coal carbonization through a horizontally directed front-side or rear-side oven opening, wherein at least one opening is provided with the inventive door device which is to be opened for charging or preparing the coke oven and which is to be closed again after charging, and wherein this door is inserted into a vertical wall which seals-off the horizontally directed oven walls to the exterior, wherein this door is moved away from the wall to open it, and wherein the doors are provided with a suitable framing device and a suitable mechanism for opening and closing, and which is characterized in that the door-side coke oven chamber opening is sealed by a combination of a rigid coke oven chamber wall and a mobile or removable door body fabricated as a plug and framed by the coke oven chamber wall, and wherein these doors exactly fit on closing into the coke oven opening, wherein the major part or the whole part of the coke oven chamber wall embracing the door is located above the coke oven chamber door, and the bottom edge of the part of the door-embracing coke oven chamber wall located above the coke oven chamber door is situated above the top edge of the coke cake.

DETAILED DESCRIPTION OF THE INVENTION

For design and construction of the inventive device, the door is so built that it can be inserted into the oven opening directly and without any further structures mounted-on. The door is designed to seal-off the oven opening as exactly fitting as possible so that no contaminants or coking products can escape to the exterior. The discharge of combustion media from the oven chamber shall exclusively be taken charge of by the "downcomer" channels constructed at the sides averted from the door.

The door preferably seals-off the oven chamber wall in flush arrangement so that there will be no projections or offsets. Then merely the door-embracing device which may for example be built as a frame or grate will project from the oven chamber door. It is also possible to construct the door as a plug in front of a door plate. The inventive device made of a refractory material is bolted to the front of a metal plate, for example, which is connected to the moving mechanism for opening or closing. But it is also possible to mount the refractory plug on a metal frame where the plugs are then fastened by the aid of bolts, screwed connections or similar facilities.

In an advantageous embodiment, the door may also evidence an offset located above or below or above and below the door and fitting exactly into the coke oven chamber opening. The offset preferably has half the thickness of the coke oven chamber door and preferably it is 50 to 500 mm tall. But it is possible to provide a different thickness or different height for the offset. The offset or offsets can be directed upwardly, downwardly or to the side and they can be provided in any arbitrary number or direction.

A preferred material for the construction of the oven door is a material containing silica or silica and aluminium oxide. These substances have a very low temperature expansion coefficient so that the door framing does not change during the coal carbonization process. Finally, however, all materials are suitable which contain an oxidic material of silicon or an oxidic material of silicon and of aluminum. A list of suitable materials is shown on Sketch 1, wherein materials containing a nearly pure silicon oxide are given preference. The doors are preferably fabricated from a uniform material. For some inventive purposes, however, it may make sense to fabricate some parts of a different material. For example, this may be a metallic material or a hydraulically setting guniting concrete.

Refractory Products

Raw Material and Composition

Sketch 1

| | | Products | Raw materials |
|---|---|---|---|
| 0 | 100 | Silica products | Quartzite |
| 10 | 90 | | |
| 20 | 80 | Siliceous fireclay products | Clays |
| 30 | 70 | | Fireclays |
| 40 | 60 | Fireclay products | Clays |
| 50 | 50 | | Fireclay-Mullite |

-continued

Refractory Products
Raw Material and Composition

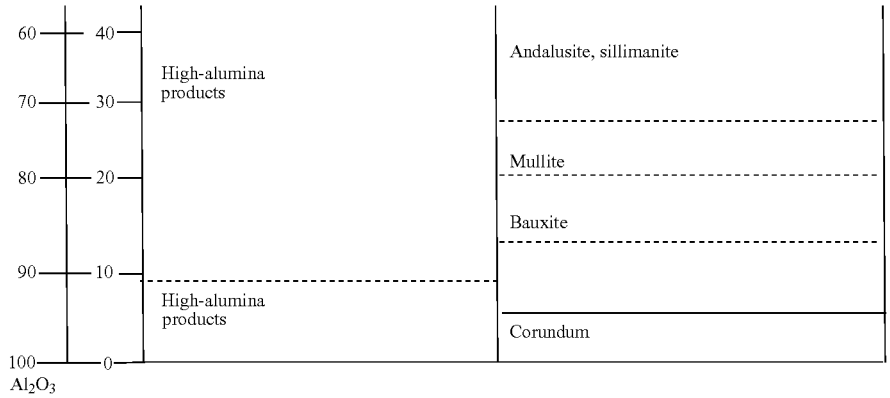

The doors can be so shaped that the coke cake is pressed into a shape that ensures a substantially more uniform heating of the coke cake. Owing to the cornered shape, particularly in the corners of the door sides directed outwardly from the oven chambers, an inhomogeneous heating of the coke oven battery often occurs which leads to a delayed coking process in the corners. The temperature is further decreased by the lack of heating flues and the existence of carrying devices in the area near the door which do not contribute to a bottom-side heating process. As a result, a coke of inferior quality is obtained. Therefore, the inventive doors may have an ellipsoidal bulge at the inside to further improve the inventive device. It is also feasible to choose an incline or offset edge instead of the ellipsoidal shape.

The problem of a more difficult coal carbonization in the door-side corners of a coke oven battery is solved by ellipsoidal bulges or inclines or offset edges which may protrude into the oven chamber, proceeding from the door. These ellipsoidal bulges are also preferably fabricated from material containing silica or silica and aluminum oxides. Owing to the decreased depth of the door, the charging quantity with coal for one cycle can be substantially enhanced.

The ellipsoidal bulge extends continually in oven inward direction as it comes closer to the floor so that the door-side corners are rounded-off. Thereby, the coal carbonization process on the whole is improved because cooler oven corners are avoided. It is also possible to mount such a bulge at the oven top, with this bulge then extending continually in oven inward direction as it comes closer to the oven top. This makes sense if the coke oven batteries are often charged up to the oven top area. Thereby, the corners in the oven top are also rounded-off, thus resulting in an improved coal carbonization process.

The device components outlined above are preferably fabricated from a material containing silica. For example, these are quartz stones or materials pressed from stones containing silicate. These materials should preferably have a low temperature expansion coefficient, and they should be mechanically stable and therefore be insensitive to material fractures. The material can be fabricated in any arbitrary kind and manner. Feasible processes are sintering processes, but also pressing and casting processes are considered suitable for fabrication of the inventive door devices. Finally, any process that leads to coke oven doors with a low temperature expansion coefficient, giving mechanical stability or having low propensity to material fractures is suitable for the manufacture of the inventive device.

The device can be provided with a heat-reflecting material, a so-called "high-emission coating", more particularly at the walls in oven inward direction. Suitable heat-reflecting materials in particular are inorganic metal oxides in a blend with carbides, with chromium or iron oxides in a blend with silicon carbides being mentioned as an example. A suitable high-reflecting material for coating the walls in oven inward direction of the inventive device is taught by EP 742276 A1. By applying such a coating, the energy efficiency of the coal carbonization process is substantially improved while temperature resistivity of walls and door devices is enhanced. As a matter of fact it is possible to coat not only the door-closing device but also the inner walls of the entire coke oven battery with a high-heat reflecting material.

Doors of all designs and structures frequently are comprised of an inner gas collecting space which is designed to relieve the doors from high inner gas pressure of the coke oven chamber. But this space is readily infiltrated by ash and coal fines, posing difficulties in process management and exacting high requirements from the door sealing material. On operation of the inventive device, one can also dispense with a plug so that a non-filled space is created between the door and coke cake. Thereby, the gases evolving on coal carbonization can be better discharged and one can dispense with the provision of a vertical gas collecting space integrated into the door.

Depending on the temperature of the coal carbonization process and on the burden of the wall material embracing the oven door, this wall can also be fabricated from a temperature-resistant material. The wall embracing the oven door is preferably fabricated from the same material as the oven door. In this case, the wall and the door have the same coefficient of expansion so that a distortion and blocking of the door structure cannot occur during heating-up and cooling-down. Even the ellipsoidal bulges are preferably comprised of the same material as the door device.

To ensure optimal execution of the coal carbonization process, the door device at its front side is provided with a retainer device that allows for pulling it out and adjusting it precisely when inserting it. This is preferably executed as a metal frame which the linkage assembly or chains for guiding the drive device are mounted to. Devices of any arbitrary kind may be utilized for opening and closing as well as charging.

To ensure optimal sealing, the door can be provided with a sealing material at its sides or at the inner wall. This material frequently is glass wool, rock wool or ceramic fibre mats. But membranes like those described in EP 724007 A1 may also be applied. The inventive door is then placed as a plug in front of the sealing membrane and the plug element base plate. Finally the door can also be provided with sealing mechanisms which are based upon resilient facilities in order to ensure absolute gas tightness of the coal carbonization process.

Clamping facilities may be applied to fasten the door to the coke oven and to latch it. But one can also implement stamps to retain the door in the oven opening. Latch bars or locks can also be used. Since silica, in particular, as a material expands just a little when temperature rises, additional sealing material usually is not necessary, especially if the oven wall directly embraces the oven door and if the oven wall is made of the same material as the oven door. According to the present invention, any arbitrary number of oven doors can be configured on one coke oven or one coke oven battery. For example, it is possible to close only one opening of two openings with the inventive door sealing device, for instance if this is necessitated by constructive conditions. But according to the present invention, it is also possible to configure several doors or openings or doors and openings.

The coke oven chamber or the coke oven battery or the coke oven bank can be arbitrarily configured to execute the inventive method. For example, it is possible to use one coke oven battery which is charged through the top. For this purpose, there are infill openings and suitable charging devices located on the oven top. Devices for ventilating the coke oven battery can also be arranged in the coke oven top. Even the inventive doors can accommodate openings for ventilation. These can be configured as flaps or even as simple tubes.

Finally it is possible to use coke oven batteries to be charged horizontally. These may also utilize ventilation devices of an arbitrary configuration. The ventilation devices can also be positioned in the wall embracing the oven door. This is even possible if the oven wall is made of the inventive refractory material. The wall located above the coke oven chamber may be comprised of further openings, for example nozzle jets, provided for ventilation.

Apart from the inventive device, a method is also claimed by which the inventive device is operated and by which a coke easier to produce and improved in quality can be obtained. For the utilization of the inventive closing device of a coke oven battery or a coke oven bank or of an individual coke oven, too, it does not matter whether the door devices are utilized to charge the coke oven or to optimize its charging.

For example, it is possible to charge the coke oven battery through the lateral and horizontally directed inventive coke oven doors. Upon completion of the coal carbonization process, well carbonized coke is pushed out from the oven again by the aid of a stamp. For charging and pushing, the oven doors are opened and after charging or pushing they are closed again. Coal may be charged into the oven battery, for example by the aid of a charging machine that can be moved on a sledge into the coke oven battery. By means of a compactor which enhances and optimizes the bulk density of initially loosely bedded coal and by means of a leveller bar which levels-off possibly arising charging cones, the coal charge is prepared for the coal carbonization process.

To execute the inventive method, however, it is also possible to charge the coke oven batteries trough charging openings located in the coke oven top. The laterally arranged openings with the inventive coke oven doors then serve for preparing the load of coal for the carbonization process, for example to enhance the bulk density or to level-off coal charge cones.

A typical process for charging of coke oven batteries through the coke oven top is described in EP 1293552 B1. According to this process, guiding devices for coal charging cars are mounted on the coke oven top, with it being possible to move mobile coal charging cars on these guiding devices for charging the relevant coke oven battery. During the charging procedure, the coal charging car is moved onto a hopper from which coal is transported via a screw conveyor and a charging telescope into the coke oven. For precise positioning into the corresponding charging position, an automatic adjustment device is utilized whose force transmission is realized through a toothed gear mechanism. Depending on the configuration of the coke oven battery, facilities for cleaning the lids are also mounted to the charging devices. It is also feasible to utilize levelling facilities which level-off the load of coal already when filling it into the coke oven chamber. An example is described in WO 2004/007640 A1.

The inventive method and the inventive method offer the advantage of an efficient and low-cost door device for coke oven batteries. The door device which exactly seals the oven opening has a high resistance to temperatures, a low temperature expansion coefficient, high mechanical strength and it is easy to seal-off with customary sealing and latching devices so that no fine ash or carbon particles can leak from the coke oven battery to the exterior. The doors are easy to manufacture and can easily be integrated into conventional coke oven chambers. Owing to its long service life, the inventive coke oven chamber sealing device leads to low operating cost in coal carbonization processes.

As a result of its good thermal insulation capacity, the doors lead to improved coke quality, particularly if corners forming on sealing are avoided by ellipsoidal offsets. On pushing the coke oven chamber, the wall lying above the coke oven chamber door prevents penetration of cold air into the coke oven chamber. Heat radiation is also reduced in this way. Consequently, coal consumption can be decreased while coke quality is improved. Owing to the decreased depth of the door, the charging quantity with coke for one cycle can be substantially enhanced.

BRIEF DESCRIPTION OF THE DRAWINGS

The inventive configuration of a device for carbonization of coal is elucidated more closely by way of four drawings, with the inventive method not being restricted to these embodiments.

FIG. 1: A coke oven chamber (1) is charged with coal and sealed-off with a door (2) made of a refractory material. Suitable materials preferably are materials containing silica or silica and aluminum oxides. The horizontally directed wall (3) embracing the oven door is also made of this material so that the door cannot get distorted due to the same thermal expansion coefficient. The door is suspended to a carrier frame (4) which a connection (4*a*) to a drive mechanism for pulling-out the door is fastened to. A connection (4*b*) for pulling-up the door is also mounted on this carrier frame. Access to the coke oven (1) can thus be obtained. Located in the coke oven is the coke cake (5) which is not filled in up to the coke oven top but only up to a certain filling level. Located there above is an oven free space (5*a*). Ventilation ports (6) by way of which primary air can be blown into the coke oven chamber are arranged at the coke oven top (7). The partly burnt gas is conducted via "downcomer" channels (8) into the secondary air sole (9) located under the coke oven floor. The "downcomers", illustrated here with openings (8*a*) in the oven free space can be guided through the coke cake (5) or through the side walls. The secondary air sole is provided with additional ventilating ports (10) which more air can stream through by means of which the coking gas is completely burnt.

FIG. 2: Upon completion of the coal carbonization process, the coke oven chamber (1) is opened to take-out the coke cake (5). The coke oven doors (2) are in opened and raised position so as to obtain access to the coke oven chamber. By means of a stamp (11), the coke cake (5) is pushed through the coke oven chamber to the other side and out of it. The wall (3) embracing the door is made of conventional material. By the existence of the front and rear side coke oven chamber wall (3) embracing the door, penetration of cold air into the coke oven chamber is prevented and heat radiation to the exterior is reduced. This can be optimized if the pushing device (11) has the same cross-section as the coke oven opening.

FIG. 3: The coke oven chamber (1) is charged with coal and sealed-off with a door made of a refractory material. The coke oven doors (1) are in closed position. Ellipsoidal offsets (1*a*) are mounted to the coke oven doors to round-off the corners and to press the coke cake (5) into the coke oven chamber. Heating is thus more uniform which contributes to improving coke quality. Mounted above the oven door in the oven walls (3) embracing the oven doors are nozzle jet-shaped ventilating tubes (12) which admit additional air into the oven, apart from the ventilating tubes on the lid (6).

FIG. 4: The coke oven (1) is in operation and provided with a closed coke oven door. The coke oven door (2) is embraced by a coke oven wall (3) that is made of the same material as the oven door. To be well seen here is the door retainer device (4) and, more particularly, the vertically directed connecting piece (4*b*) for pulling-up the door in opened position. Here, one can also see flaps (13) for regulating the air intake into the secondary air sole.

LIST OF REFERENCE SYMBOLS

Figure 1:
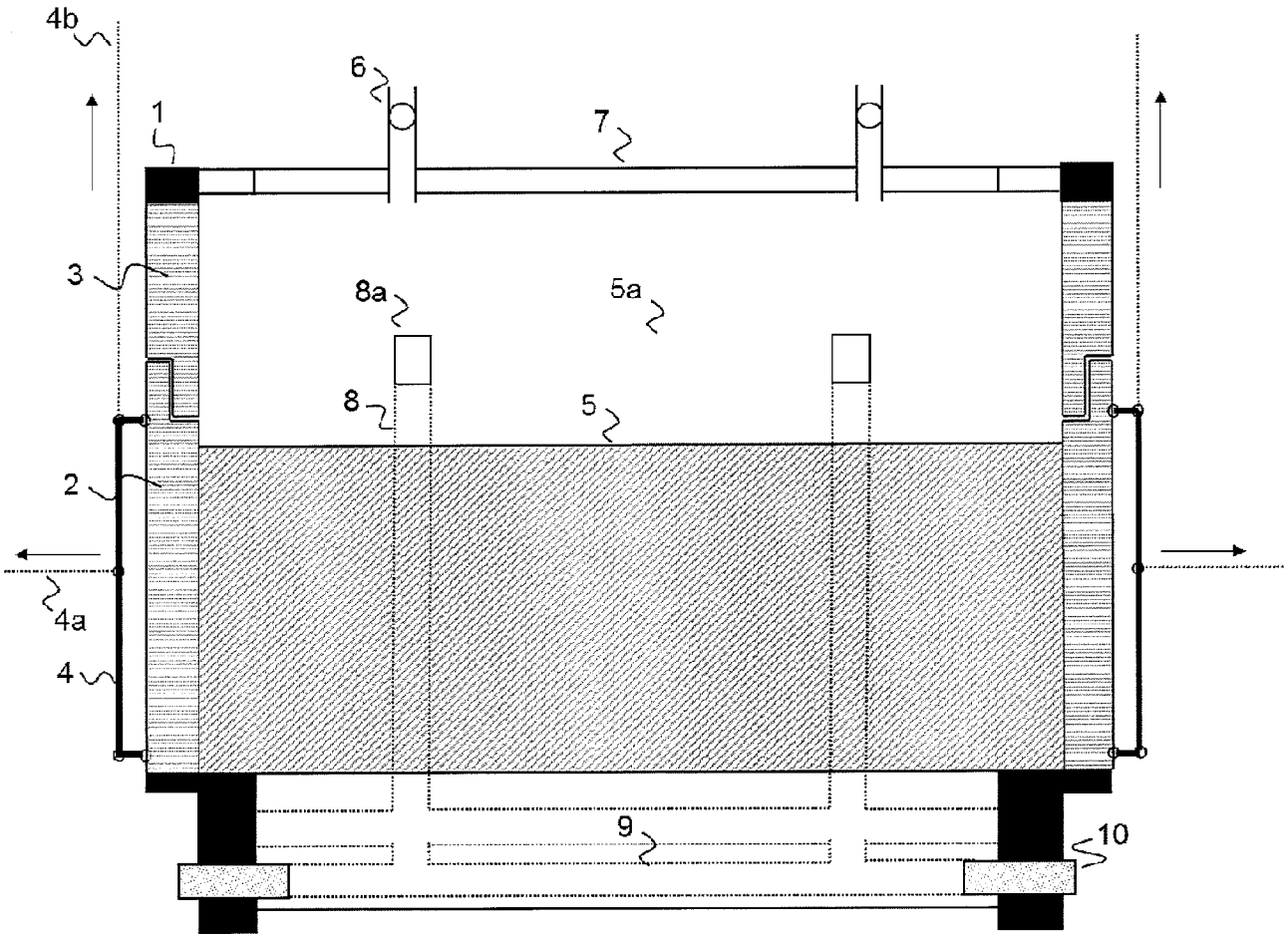
FIG. 1 shows a coke oven chamber in a side view with the inventive and closed door sealing device. Both the coke oven door and the coke oven chamber wall embracing the door are made of the inventive refractory material.
Figure 2:
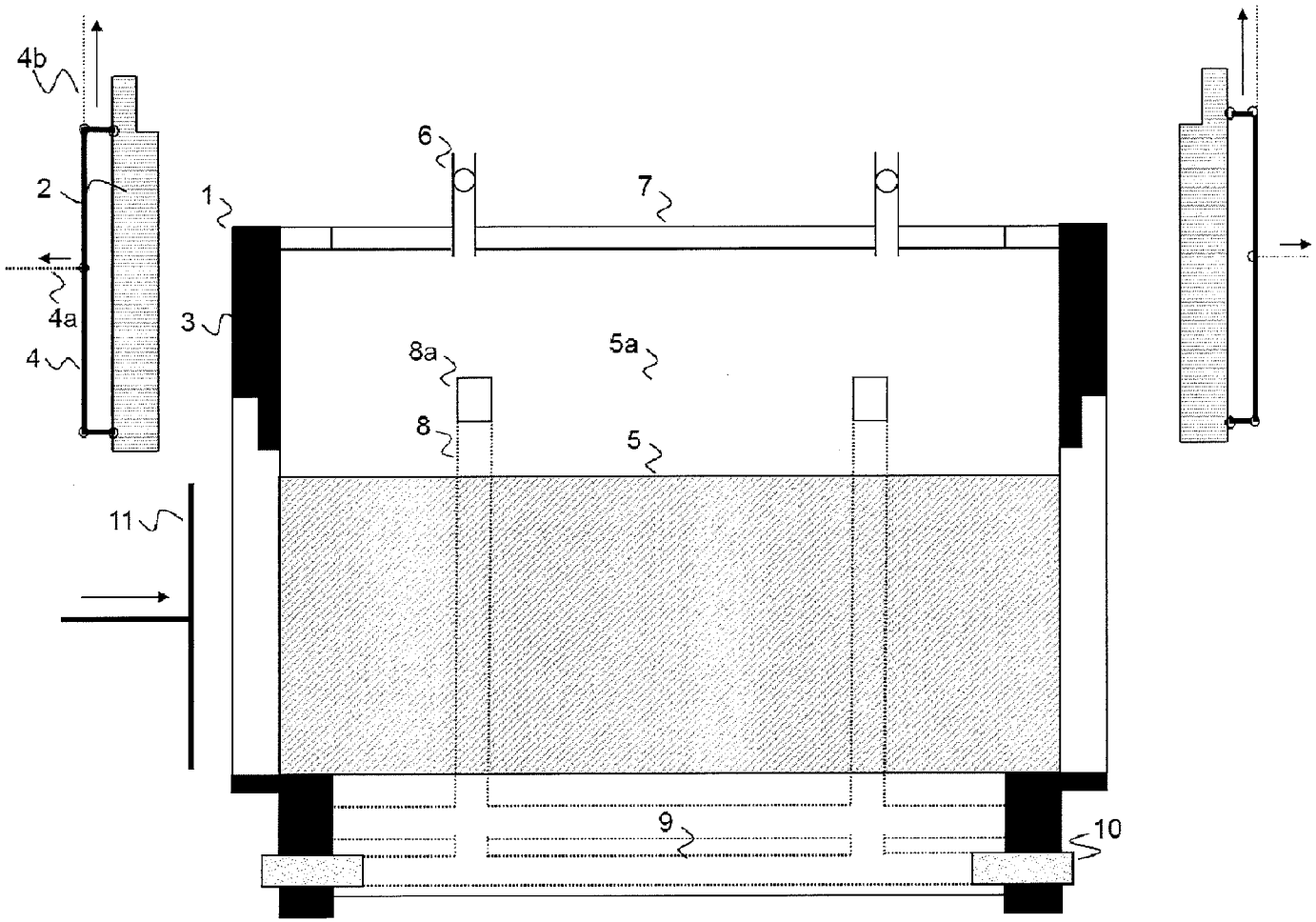
FIG. 2 shows a coke oven chamber in a side view with the inventive and opened door sealing device. Only the coke oven chamber door is made of the inventive refractory material.
Figure 3:
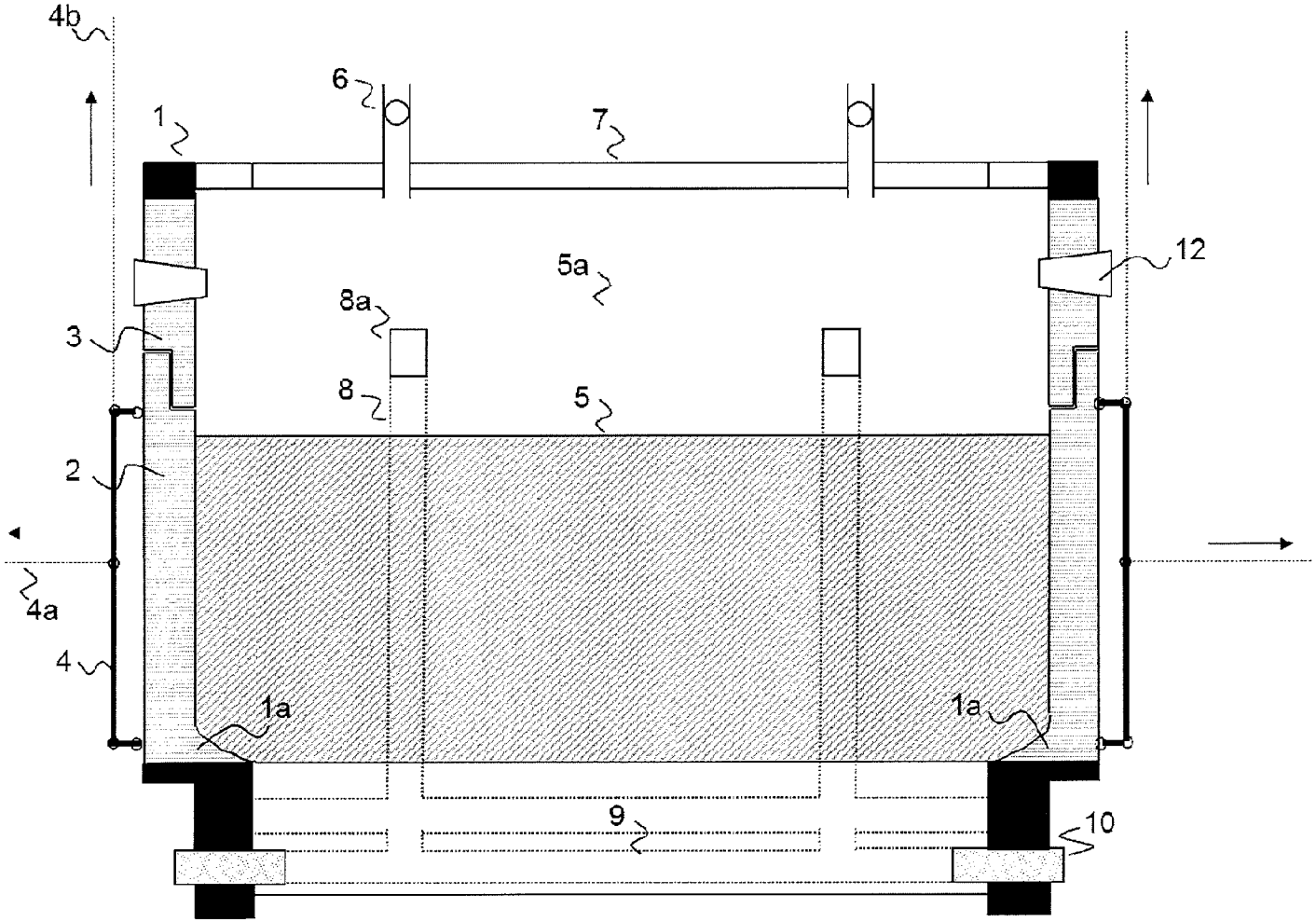
FIG. 3 shows a coke oven chamber in a side view with the inventive and closed door sealing device. Both the coke oven door and the coke oven chamber wall embracing the door are made of the inventive refractory material. The embracing coke oven chamber wall is comprised of a nozzle jet-shaped opening for ventilation. Ellipsoidal offsets to round-off the coke oven chambers are mounted in the lower coke oven corners.
Figure 4:
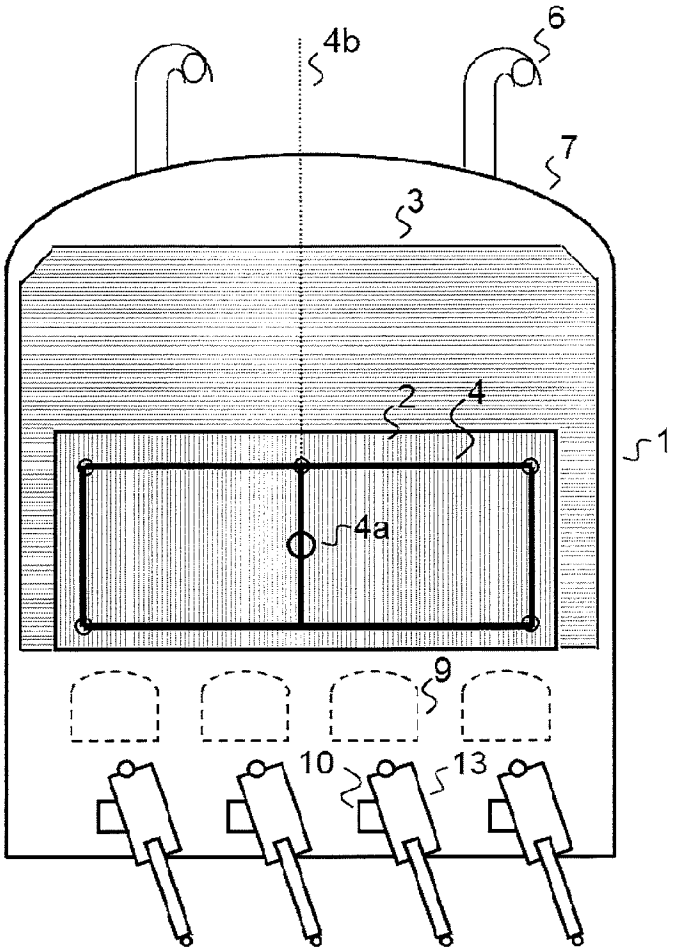
FIG. 4 shows a coke oven chamber in a front view. Both the coke oven door and the coke oven chamber wall embracing the door are made of the inventive material.

1 Coke oven chamber
2 Inventive coke oven door
3 Horizontally directed coke oven wall embracing the door
4 Door retainer device (door jamb)
4*a* Horizontally directed connecting piece to the driving mechanism
4*b* Vertically directed connecting piece to the opening mechanism
5 Coke oven cake
5*a* Oven free space
6 Ventilating device as a tube through the coke oven top
7 Coke oven top
8 "Downcomer" tubes
8*a* Openings of "downcomer" tubes
9 Secondary air soles
10 Feeding facilities for secondary air
11 Stamp for pushing the coke cake
12 Nozzle jet-shaped openings for admission of primary air
13 Flaps for regulation of secondary air

The invention claimed is:

1. A device for sealing-off a coke oven which is charged or prepared for coal carbonization through a horizontally directed front-side or rear-side oven opening, comprising a coke oven chamber door and a coke oven chamber wall; wherein at least one opening is provided with the door device which is to be opened for charging or preparing the coke oven and which is to be closed again after charging, the door is inserted into a vertical wall which seals-off horizontally directed oven walls to the exterior, wherein this door is moved away from the wall to open it, the doors are provided with a suitable framing device and a suitable mechanism for opening and closing, and the door-side coke oven chamber opening is sealed by combination of a rigid coke oven chamber wall and a mobile or removable door body fabricated as a plug and framed by the coke oven chamber wall, and wherein these doors exactly fit on closing into the coke oven opening, wherein the major part or the whole part of the coke oven chamber wall embracing the door is located above the coke oven chamber door.

2. The device according to claim 1, wherein the coke oven chamber door is comprised of offsets directed upwardly, downwardly or towards the side and located on the door outside.

3. The device according to claim 2, wherein the offset in the coke oven chamber door has roughly half the door width and a height of 100 to 500 mm.

4. The device according to claim 1, wherein the coke oven chamber doors are so built-up that the refractory plugs are fastened on a metallic frame by means of bolts, screwed connections or similar appliances.

5. The device according to claim 1, wherein these doors are made of a refractory and thermally insulating material in one piece or several pieces.

6. The device according to claim 1, wherein the coke oven doors are fabricated from a material comprising silica.

7. The device according to claim 1, wherein the coke oven doors are fabricated from a material comprising silica and aluminum oxides.

8. The device according to claim 1, wherein the oven comprises an underside with doors at the underside, and the doors at the oven underside have ellipsoidal bulges or inclines or offset edges directed towards the interior, whose longitudinal side is directed downwardly and which extend in the direction towards the oven interior as they come closer to the floor so that the coke cake is pressed away from the lower oven corners.

9. The device according to claim 8, wherein the ellipsoidal bulge or incline or offset edge is fabricated from a material comprising silica.

10. The device according to claim 8, wherein the ellipsoidal bulge or incline or offset edge is fabricated from a material comprising silica and aluminum oxides.

11. The device according to claim 1, comprising a heat-reflecting coating.

12. The device according to claim 1, wherein the entire coke oven battery including the coke oven doors and walls or the coke oven doors and walls are provided with a heat-reflecting coating.

13. The device according to claim 1, wherein the wall embracing the coke oven door comprises a refractory and thermally insulating material.

14. The device according to claim 13, wherein the wall embracing the coke oven door is fabricated from a material comprising silica.

15. The device according to claim 13, wherein the wall embracing the coke oven door is fabricated from a material comprising silica and aluminum oxides.

16. The device according to claim 1, wherein the walls embracing the door have an ellipsoidal bulge or an incline or an offset edge at the oven upper side, the longitudinal side of which is upwardly directed so that the coke cake is pressed away from the upper oven corners embracing the door.

17. A method for sealing-off a coke oven which is charged or prepared for coal carbonization through a horizontally directed front-side or rear-side oven opening, the coke oven comprising a coke oven chamber door and a coke oven chamber wall; wherein at least one opening is provided with the door device which is to be opened for charging or preparing the coke oven and which is to be closed again after charging, the door is inserted into a vertical wall which seals-off horizontally directed oven walls to the exterior, wherein this door is moved away from the wall to open it, the doors are provided with a suitable framing device and a suitable mechanism for opening and closing, and the door-side coke oven chamber opening is sealed by combination of a rigid coke oven chamber wall and a mobile or removable door body fabricated as a plug and framed by the coke oven chamber wall, and wherein these doors exactly fit on closing into the coke oven opening, wherein the major part or the whole part of the coke oven chamber wall embracing the door is located above the coke oven chamber door, the method comprising:

moving the coke oven chamber door out from and into the door-side coke oven chamber opening so that the coke oven chamber opens and closes, with the coke oven chamber opening having the same cross-section as the coke oven chamber door, and situating the bottom edge of the part of the door-embracing coke oven chamber wall located above the coke oven chamber door above the top edge of the coke cake.

18. The method for sealing-off a coke oven according to claim 17, wherein:

the closing device is opened with a stamp device for charging the coke ovens with a suitable charging mechanism, for a subsequent alignment and leveling-off of the coke cake and pushing-out the coke cake.

19. The method according to claim 17, wherein the closing device is opened only for alignment and leveling of the coke cake and that the actual charging of the coke oven is realized with coal charging cars through the oven top.

20. The method according to claim 17, wherein the charging of the coke oven battery is realized by coal charging cars through coke oven lids which are equipped with a cleaning device for removal of coke.

21. The method according to claim 17, wherein the bottom edge of the coke oven chamber wall part located above the coke oven chamber door is located at least 50 mm and maximally 500 mm above the top edge of the coke cake.

22. The method according to claim 17, wherein the bottom edge of the coke oven chamber wall part located above the coke oven chamber door is located at least 100 mm and maximally 200 mm above the top edge of the coke cake.

* * * * *